United States Patent [19]

Kromer et al.

[11] 4,359,990

[45] Nov. 23, 1982

[54] FUEL INJECTION SYSTEM

[75] Inventors: Gunter Kromer, Heilbronn; Armin Bauder; Gerhard Maurhoff, both of Neckarsulm, all of Fed. Rep. of Germany

[73] Assignee: Audi NSU Auto Union Aktiengesellschaft, Fed. Rep. of Germany

[21] Appl. No.: 115,067

[22] Filed: Jan. 24, 1980

[30] Foreign Application Priority Data

Feb. 9, 1979 [DE] Fed. Rep. of Germany ..... 2904976

[51] Int. Cl.[3] ..... F02B 3/00

[52] U.S. Cl. ..... 123/453; 123/454

[58] Field of Search ..... 123/454, 453

[56] References Cited

U.S. PATENT DOCUMENTS 4,220,129 9/1980 Steinwart ..... 123/453

4,227,502 10/1980 Steinwart ..... 123/454

4,243,002 1/1981 Freyer ..... 123/454

*Primary Examiner*—Ronald B. Cox

*Attorney, Agent, or Firm*—Kane, Dalsimer, Kane, Sullivan and Kurucz

[57] ABSTRACT

A continuous fuel injection system for an internal combustion engine including a fuel metering valve 7 operating at a controlled pressure difference between chambers 13,14, the pressure difference being automatically adjusted by a regulating valve 17 including a diaphragm 18 separating two chambers 19,20. Chamber 20 is connected to relief 60 via a movable valve element 35 and the second chamber 19 is connected to the pressure upstream of the metering valve. The pressure difference is determined by a spring system acting on the diaphragm 18 including a stronger spring 33 which acts directly on the diaphragm and a weaker spring 34 which acts as a contact spring holding the valve body 35 lightly in contact with the diaphragm.

7 Claims, 2 Drawing Figures

FUEL INJECTION SYSTEM

Figure 1:
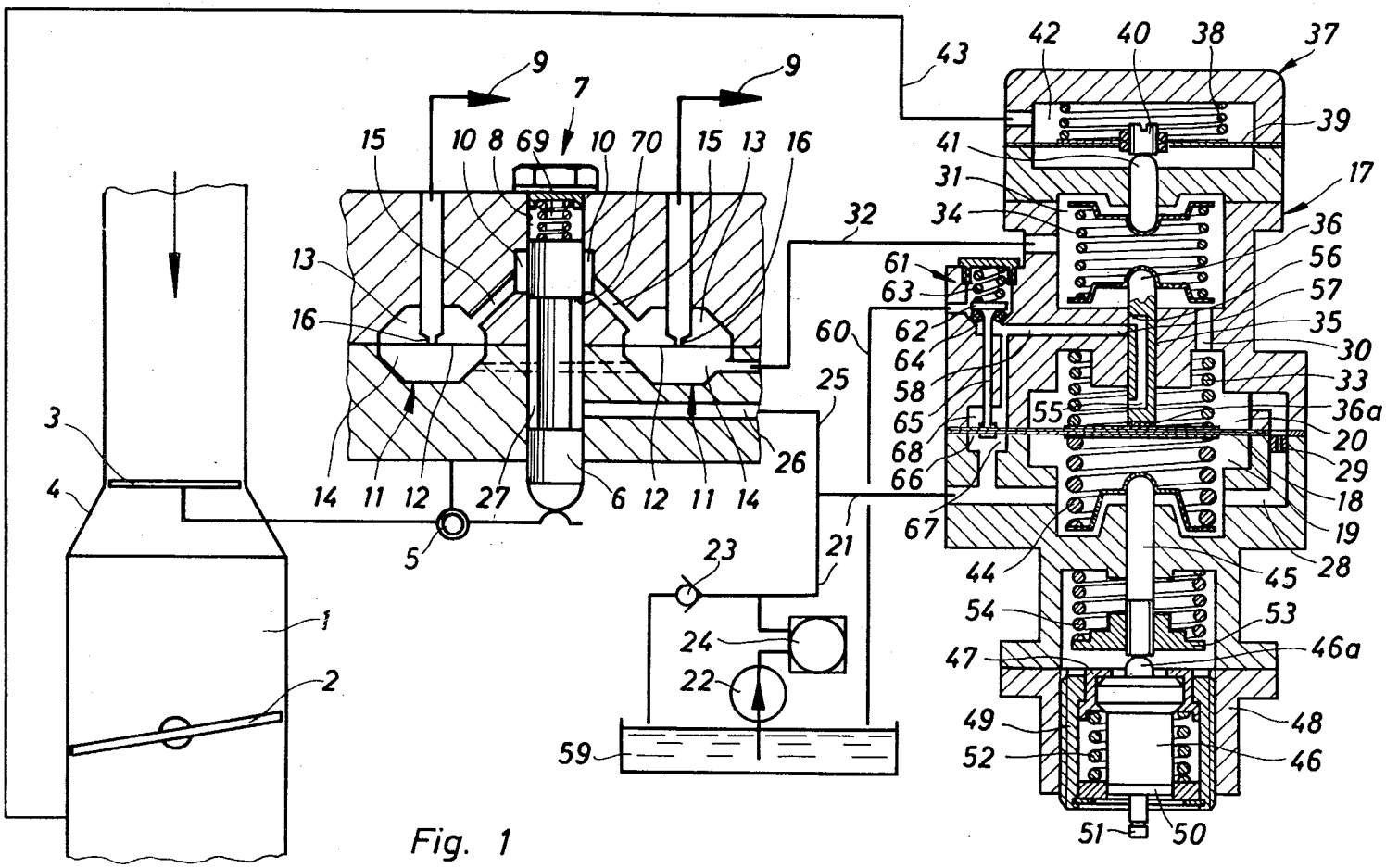

The invention relates to a fuel injection system for a mixture-compressing spark ignition internal combustion engine with continuous injection, including an air inlet passage containing an adjustable throttle valve and a flow sensing device for measuring the rate of air flow and arranged to actuate a fuel metering valve, in which fuel metering occurs at a controlled constant pressure difference but one which is variable in accordance with operating parameters of the engine and can be adjusted by a differential pressure regulating valve which has two chambers separated from each other by a diaphragm, the first chamber being in communication with a return pipe via a valve element which can be moved in a bore by the diaphragm, whilst the second chamber is subject to the pressure upstream of the metering valve, and in which the level of the constant pressure difference is determined, amongst other things by the force of a spring which bears on the diaphragm and opposes the pressure in the second chamber.

A differential pressure regulating valve has been proposed in which the spring which determines the level of the differential pressure in the metering valve acts on the diaphragm via the valve element. This spring may however tilt the valve body element inside the bore, leading to undesirable increased friction which results in inadmissible variations in differential pressure and impairs the accuracy of the fuel metering.

An object of the invention is to provide a fuel injection system of the type mentioned above, in which friction acting on the valve element is reduced as much as possible.

Broadly stated the invention consists in a fuel injection system for a mixture-compressing spark ignition internal combustion engine with continuous injection, including an air inlet passage containing an adjustable throttle valve and a flow sensing device for measuring the rate of air flow and arranged to actuate a fuel metering valve, in which fuel metering occurs at a controlled constant pressure difference but one which is variable in accordance with operating parameters of the engine and can be adjusted by a differential pressure regulating valve which has two chambers separated from each other by a diaphragm, the first chamber being in communication with a return pipe via a valve element which can be moved in a bore by the diaphragm, whilst the second chamber is subject to the pressure upstream of the metering valve, and in which the level of the constant pressure difference is determined, amongst other things by the force of a spring which bears on the diaphragm and opposes the pressure in the second chamber, the spring force acting on the diaphragm being determined by two springs of different spring rates or strength, one stronger spring being arranged to act directly against the diaphragm, whilst the weaker spring acts as a contact spring and acts on the diaphragm through the movable valve element of the differential pressure regulating valve.

In the preferred constructional forms of the invention, in which the stronger spring bears directly against the diaphragm and does not act on the diaphragm via the valve element as in previous differential pressure regulating valves, friction between the valve element and its bore is reduced to such an extent that satisfactory operation of the differential pressure regulating valve is achieved. The spring force of the additional contact spring which keeps the valve element constantly in contact with the diaphragm is so small on the other hand, that the valve element does not tilt and is not pressed against the inside wall of its bore and as a result, little or no friction arises to impair the movability of the valve element.

To obtain fuel metering which is suitable for any particular operating condition, the force of the contact spring acting on the valve element, and therefore the differential pressure, can be varied in dependence upon the load condition of the engine and/or in dependence upon the exhaust gas composition. For this a device which senses the load condition can be arranged to bear against the contact spring so that on full load it moves in a direction to increase the force of the contact spring. In one preferred specific embodiment, the device may comprise a diaphragm chamber connected via a low pressure pipe to the intake passage of the engine, downstream of the throttle valve.

It may be desired to vary the force of the contact spring in dependence upon the exhaust gas composition. For this purpose the system may include a device which bears against the contact spring and moves in a direction to reduce the force of the contact spring when exhaust gas values with lambda smaller than 1 are detected, and when exhaust gas values with lambda greater than 1 are detected, moves in a direction to increase the force of the contact spring, whereby fuel metering is reduced or increased. The device may for example, comprise a lifting magnet, which is connected to a lambda probe (oxygen probe) located in the exhaust pipe in known manner. With a value of lambda $>1$ there is an excess of air, and with lambda $>1$ there is a deficiency of air.

Figure 2:
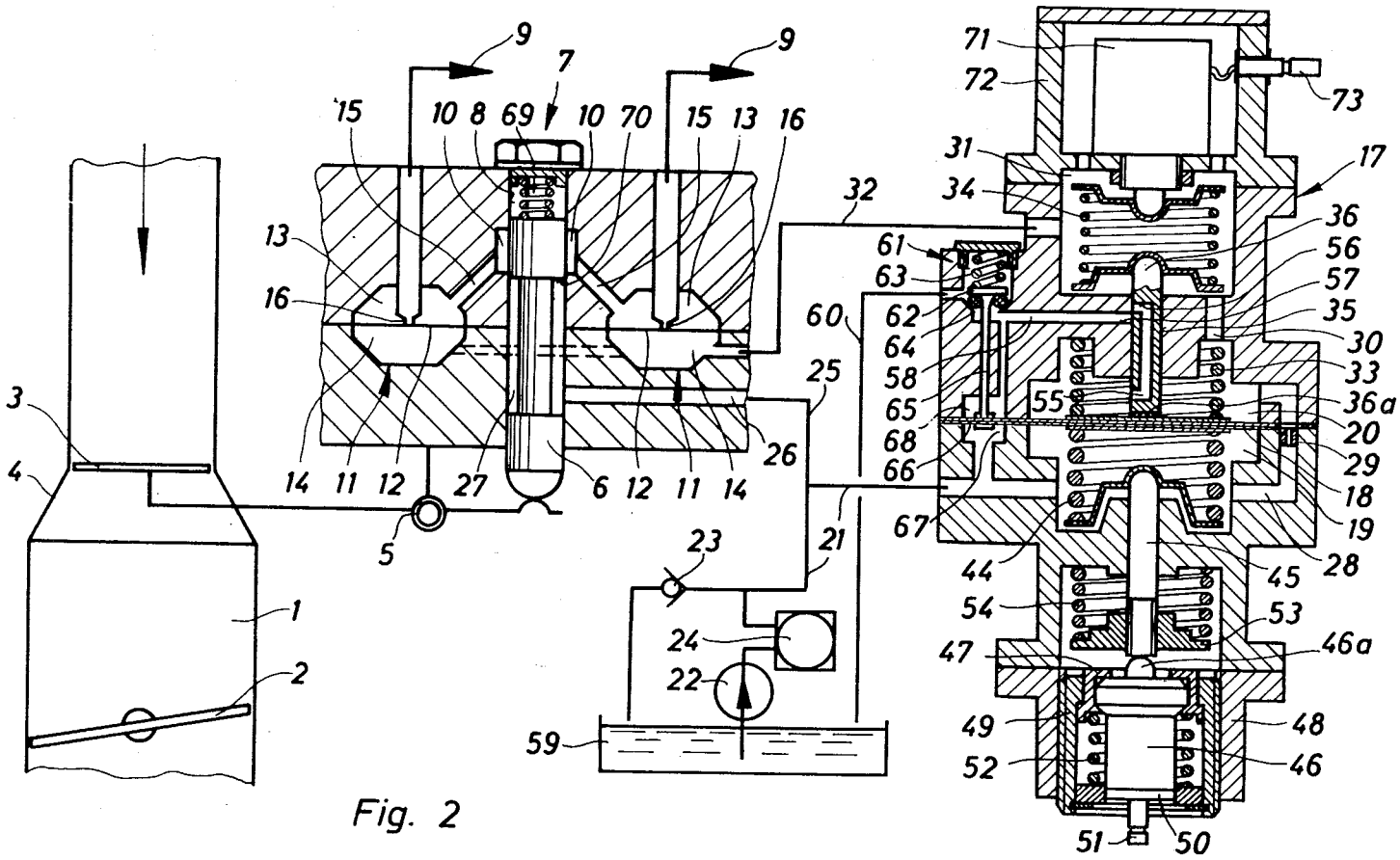

The invention may be performed in various ways and two embodiments of the invention will now be described in greater detail by way of example with reference to the accompanying drawings, in which:

FIG. 1 is a somewhat diagrammatic sectional view of a fuel injection system with a differential pressure regulating valve in accordance with the invention, and FIG. 2 is a similar view of the second embodiment.

In the embodiment shown in FIG. 1, numeral 1 denotes an air intake passage of a mixture-compressing spark ignition internal combustion engine, including an adjustable throttle valve 2 and a flow sensing device 3, which moves according to the quantity of air flowing in the direction of the arrow. The device 3 is in the form of a baffle plate and is located in or adjacent a conical section 4 of the intake passage 1. The baffle plate 3 is pivotably mounted at 5, and acts upon a movable valve piston 6 of a fuel proportioning or metering valve 7. The valve piston 6 is located in a cylindrical bore 8, in the wall of which a number of control slots 10 are provided, corresponding to the number of injection nozzles 9 as indicated by arrows. Connected to each control slot 10 is a diaphragm valve 11, which has two chambers 13 and 14 separated from each other by a diaphragm 12. Each chamber 13 communicates via a passage 15 with the respective control slot 10, and communicates with the respective injection nozzle 9 via a valve aperture 16, which is controlled by the diaphragm 12.

A differential pressure regulating valve 17 forming part of the fuel injection system, has two chambers 19 and 20, separated from each other by a diaphragm 18. An electrically driven fuel pump 22 supplies fuel via a pipe 21 to the chamber 19 at system pressure, which is determined by a system pressure retaining valve 23. A fuel accumulator 24 is located in the pipe 21 immediately downstream of the fuel pump 22. The chamber 19 also communicates through a pipe 25 and a passage 26 with an annular groove 27 in the valve piston 6 of the fuel metering valve 7. The chamber 20 is connected to the chamber 19 via a bypass passage 28 with a throttle 29, and is connected by a communicating passage 30 and a spring chamber 31 via a pipe 32 to the second chambers 14 of all the diaphragm valves 11.

Bearing on the face of the diaphragm 18, which forms part of the first chamber 20, are two springs of different spring force. One of the springs 33 bears directly on the diaphragm 18 with a relatively large spring force of approximately 6.6 kp. The second spring 34 serves as a contact spring of smaller spring force (approximately 0.5 kp) and its lower end bears against the diaphragm 18 via a valve body 36 which passes through the first chamber 20 and is movable in a bore 35, a plastic contact plate **36*a* being located between the valve body 36 and the diaphragm 18 to reduce wear. On the other side of the contact spring 34 is located a device comprising a diaphragm box 37 which reacts to the instantaneous load condition of the engine. The diaphragm box 37 includes a diaphragm 39 which defines a low pressure chamber 42 and is engaged by a compression spring 38, and co-operates with the spring 34 via a setting screw 40 and an adjusting pin 41 which is movable in the housing of the diaphragm box 37. The low pressure chamber 42 is connected via a pipe 43 to the intake passage 1, downstream of the throttle valve 2**.

Against the other side of the diaphragm 18 which faces the second chamber 19, bears a spring 44 having a spring force of approximately 0.9 kp. This spring butts against a device for cold starting enrichment, via an adjusting pin 45 which passes through the second chamber 19. The device for cold starting enrichment comprises a thermo-couple 46, which is mounted in a threaded bushing 49, movable in a housing, by means of a flanged ring 47. Attached to the thermocouple 46 is an additional heating element 50 such as, for example, a PTC element supplied with electric heater current via a contact 51. The flanged ring 47 is arranged to be movable against the spring force of a compression spring 52, inside the threaded bushing 49, so that the thermo-couple can expand downwards when heated. An adjustable spring plate 53 is located on a thread on the adjusting pin 45 located between the thermocouple 46 and the spring 44 and when the thermo-couple 46 is moved, the spring plate is pressed approximately 4.5 mm upwards and is brought into contact with the wall defining the chamber 19. In this position, the spring 44 also generates a spring force of approximately 4.6 kp, the differential pressure being set at approximately 0.18–0.45 bars. As a result of the arrangement and action of the springs 33 and 34 on the one hand, and the springs 44 and 54 on the other hand, the valve body 36 is almost entirely relieved of spring resistance which might impair its movability. The differential pressure valve, together with the device 37 reacting to the load condition of the engine, and the device 48,50 for cold starting enrichment, form a compact structural unit.

The pressure in the first chamber 20, which determines the differential pressure at the proportioning valve 7, is controlled by the device reacting to the load condition of the engine and by the device for cold starting enrichment, which act on opposite sides against the diaphragm 18 and open the flow cross-section through the valve body 36 to a greater or lesser extent and thus vary the difference in pressure between the chambers 19 and 20. To this end, the valve body 36 is formed with a passage 55 connected to the chamber 20, and also to a control aperture 56, which co-operates with an outlet port 57 located in the wall of the bore 35. The outlet port being connected by a return passage to a return pipe 60 which discharges into the fuel tank 59. By means of the setting screw 40 and the adjustable spring plate 53, the spring tolerances and spring rates can be compensated and the tension of the several springs be adjusted in such a way that the desired level of differential pressure is obtained in the proportioning valve.

In the return passage 58 is located a stop valve 61, which includes a valve body 62 pressed by a spring 63 tightly against a valve seat 64 in the normal position of rest. A valve stem 65 connected to the valve body 62 is attached to a diaphragm 66 which defines a lower chamber 67 which is subject to the system pressure via the pipe 21, and also defines an upper chamber 63 connected to the return passage 58. Under running conditions the system pressure acts against the diaphragm 66, so that the stop valve 61 is opened and the return pipe is relieved. Through the stop valve 61, the pressure in the differential pressure regulating valve 17 is also maintained for a considerable time after the engine is switched off, so that vapour bubbles do not form. As a result, the fuel injection system with the differential pressure regulating valve 17 is always ready for operation.

As can be seen, the stop valve 61 is integrated in the housing of the differential pressure regulating valve 17, and its diaphragm 66 forms part of the diaphragm 18 of the differential pressure regulating valve. Hence little or no extra space is required for the stop valve.

Fuel delivered by the fuel pump 22 passes through the pipe 21 not only into the second chamber 19 of the differential pressure regulating valve 17, but also through a pipe 25 and passage 26 into the annular groove 27 of the valve piston 6. The valve piston 6 is moved upwards out of its rest position by the baffle plate 3, according to its deflection by the quantity of air flowing through the inlet passage 1. This is opposed by a counter-force produced by a spring 69 in the illustrated example, such that its control edge 70 opens the control slots 10 to a greater or lesser extent, in proportion to the deflection of the baffle plate 3. Fuel therefore passes through the passages 15 in the first chambers 13 of the diaphragm valves 11, and thence through the valve ports 16 to the respective injection nozzles 9.

To ensure that the quantity of fuel supplied to the injection nozzles 9 is appropriate to the particular instantaneous running condition of the engine, the level of the differential pressure is determined via the diaphragm box 37 and via the thermo-couple 46 in dependence upon the load condition and the running temperature of the engine, which vary the prestress of the springs 33 and 34 and also springs 44 and 54 acting upon the diaphragm 18. If the throttle valve 2 is opened from the position shown, for example, a reduction of the suction effect in the low pressure chamber 42 occurs, so that the compression spring 38, via the spring 34, presses more strongly against the valve body 36 and actuates the latter in an opening direction, to cause fuel enrichment. Fuel enrichment during warming up of the engine after a cold start is obtained by the fact that the pin **46*a* of the thermocouple 46 is retracted as shown, and the initial force of the spring 44 therefore reduced. Thus the valve body 36** is also actuated in an opening direction. Depending upon the operating engine conditions, intermediate positions are naturally produced under the influence of the two operating parameters, so as to provide appropriate fuel metering.

In the second embodiment illustrated in FIG. 2, the same reference numerals as in FIG. 1 are used for identical and similar parts. By comparison with the embodiment of FIG. 1, a lifting magnet 71 is provided instead of the diaphragm box 37. The lifting magnet 71 acts directly on the spring 34, and is located in a housing 72 so as to be adjustable by means of a screw thread, and has a contact 73 which is connected to a lambda probe in the exhaust pipe of the engine (not illustrated).

If the lambda probe, when the engine is running, detects an exhaust gas composition with an excess of air ($\lambda < 1$), the lifting magnet 71 is influenced in a direction to increase the force of the spring 34, whereby the valve body 36 is actuated in an opening direction and fuel enrichment results. If, on the other hand, the lambda probe detects an exhaust gas composition with an air quantity of ($\lambda < 1$), the lifting magnet 71 is influenced in a direction to reduce the force of the spring 34, so that the valve body 36 is shifted in the closing direction.

Many modifications of the illustrated embodiments are obviously possible within the scope of the invention. The operating parameters referred to, and further operating parameters which are not mentioned, can be detected and read off in various different ways, and be used to regulate the differential pressure via a variety of adjusting elements such as, for example, electric or hydraulic servomotors, which act upwards or downwards on the valve body 36.

We claim:

1. A fuel injection system for a mixture-compressing spark ignition internal combustion engine with continuous injection including an air inlet passage containing an adjustable throttle valve, said fuel injection system comprising:

a flow sensing device for measuring the rate of fuel flow;

a fuel metering valve, actuated by the flow sensing device, in which fuel metering occurs at a controlled constant pressure difference; and a differential pressure regulating valve which adjusts the fuel metering valve, said differential pressure regulating valve having a first chamber and a second chamber separated from the first chamber by a diaphragm, the first chamber being in communication with a return pipe via a valve element which can be moved in a bore by the diaphragm, and the second chamber being subject to pressure upstream of the metering valve, said differential pressure regulating valve also having a first spring means acting upon the side of the diaphragm facing the first chamber, and a second spring means acting upon the side of the diaphragm facing the second chamber, said first means comprising a strong spring acting directly on the diaphragm and a contact spring which keeps a movable valve element in contact with the diaphragm wherein the constant pressure difference supplied by the differential regulatory valve to the fuel metering valve is varied in accordance with the operating conditions of the engine by varying the force of the contact spring.

2. A fuel injection system as claimed in claim 1, in which the force of the contact spring can be varied in accordance with the load condition of the engine.

3. A fuel injection system as claimed in claim 1, in which the force of the contact spring is variable, in accordance with the composition of the exhaust gas.

4. A fuel injection system as claimed in claim 2, wherein said force is varied by a load sensing for sensing the engine load condition and arranged to bear against the contact spring and to move in a direction to increase the force of the contact spring under full load.

5. A fuel injection system as claimed in claim 4, in which the load sensing device comprises a diaphragm chamber connected to the inlet passage of the engine, downstream of the throttle valve.

6. A fuel injection system as claimed in claim 3, wherein said force is varied by a device which reacts to the exhaust gas composition and acts on the contact spring, such that when exhaust gas values with lambda smaller than 1 are detected, the device moves in a direction to reduce the force of the contact spring, and when exhaust gas values with lambda larger than 1 are detected, moves in a direction to increase the force of the spring.

7. A fuel injection system as claimed in claim 6, in which the device comprises a lifting magnet connected to a lambda probe located in the exhaust pipe of the engine.

* * * * *

UNITED STATES PATENT AND TRADEMARK OFFICE

CERTIFICATE OF CORRECTION

PATENT NO. : 4,359,990

DATED : November 23, 1982

INVENTOR(S) : Gunter Kromer, et al

It is certified that error appears in the above—identified patent and that said Letters Patent is hereby corrected as shown below:

Column 2, line 33, "lambda > 1" should be

--lambda < 1--.

Column 5, line 16, "($\lambda$ < 1)" should be

--($\lambda$ > 1)-- .

Signed and Sealed this

*Eleventh* Day of *January 1983*

[SEAL]

*Attest:*

GERALD J MOSSINGHOFF

*Attesting Officer*

*Commissioner of Patents and Trademarks*